United States Patent [19]

Tamba et al.

[11] Patent Number: 4,784,088

[45] Date of Patent: Nov. 15, 1988

[54] DRIVE DEVICE FOR COOLANT PUMPS

[75] Inventors: Shinichi Tamba, Kakogawa; Akio Miguchi, Kobe, both of Japan

[73] Assignee: Kawasaki Jukogyo Kabushiki Kaisha, Kobe, Japan

[21] Appl. No.: 932,679

[22] Filed: Nov. 20, 1986

[30] Foreign Application Priority Data

Dec. 5, 1985 [JP] Japan ..... 60-187741[U]
Aug. 8, 1986 [JP] Japan ..... 61-187090

[51] Int. Cl.[4] ..... F01P 5/10

[52] U.S. Cl. ..... 123/41.47; 123/41.44; 74/DIG. 10; 415/122 R

[58] Field of Search ..... 123/41.47, 41.44; 74/DIG. 10, 434, 431, 432; 403/257, 247; 415/122 R

[56] References Cited

U.S. PATENT DOCUMENTS

| | | | |
|---|---|---|---|
| 646,708 | 4/1900 | Rumely | 415/122 |
| 1,282,639 | 10/1918 | Schueler | 415/122 |
| 1,383,380 | 7/1921 | Boggs | 415/122 |
| 1,402,059 | 1/1922 | Eich | 415/122 |
| 3,457,234 | 7/1969 | Gianathsio | 74/434 |
| 4,198,935 | 4/1980 | Seibt et al. | 123/41.47 |
| 4,530,313 | 7/1985 | Zaremba | 123/41.47 |

*Primary Examiner*—Carroll B. Dority, Jr.

[57] ABSTRACT

A drive device for coolant pumps having a pump shaft, a boss having a bore in which the pump shaft is rotatably disposed and a driven gear made from synthetic resin to transmit the rotational power from the crankshaft to the impeller to move the coolant into circulation through the coolant jacket for engine cooling, is disclosed which comprises a pin, fixedly implanted in radial pattern in the circumference of the pump shaft, a couple of radially extending grooves outwardly from the center of the driven gear bore in that side of the driven gear facing the impeller to receive therein fittingly the pin, respectively, and a washer mounted about the pump shaft between the front end face of the bore and the pin so as to prevent the pump shaft from falling off from its bore. When the driven gear is driven by the crankshaft, the pin closely fitted in the grooves transmits the torque to the pump shaft, without any slip. This arrangement can eliminates the conventional metal bushing fitted in the driven gear about the pump shaft to insure fit between the pump shaft and driven gear.

2 Claims, 4 Drawing Sheets

DRIVE DEVICE FOR COOLANT PUMPS

BACKGROUND OF THE INVENTION (1) Field of the Invention

This invention relates to a drive device for coolant pumps in liquid-cooled internal combustion engines.

(2) Description of the Prior Art

In internal combustion engines of the liquid cooled type for tractors and agricultural machines in particular, a coolant pump, which is normally installed in the cover of the crankcase or transmission case, is driven by a crankshaft or camshaft through a train of gears to move coolant by the rotation of an impeller to be circulated through a coolant jacket for engine cooling during the operation. The impellers of such pumps are mounted on a rotatably disposed shaft which is driven by a driven gear secured to the shaft, with the gear in turn being driven by a driven gear mounted on the crankshaft or camshaft.

In the prior art coolant pumps, referring to FIGS. 5 and 6 illustrating the two typical conventional coolant pumps, a pump 7 comprises a pump shaft 11 carrying at a rear end thereof an impeller 10 and a pump body 8 including an inlet port 35 to admit the coolant into the pump body 8. The rotation of the impeller 10 causes the coolant to move, by the action of centrifugal force, into an outlet and circulate through a coolant jacket 38 cooling the engine 1.

A driven gear 15 is secured to a front end portion of the pump shaft 11 and is connected in mesh engagement with a crankshaft gear 17 through an intermediate gear such as a camshaft gear 16 which drives the pump shaft 11 and hence the impeller 10 through the driven gear 15 when the engine 1 is running. The pump body 8 includes a boss **8*a* with a central bore in which the pump shaft 11 is supported adjacent to its front end through bearings 40, which may be provided in a pair in the boss bore, as may best be depicted in FIG. 6. Also, the pump 7 comprises an annular mechanical seal 30 and a sealing ring 34 mounted about the shaft 11 adjacent to the impeller 10 to prevent leakage of coolant from the pump body 8 down along the circumference of the pump shaft 11**.

The pump shaft 11 is pressure fitted into the central bore of the driven gear 15, with such force as to prevent the driven gear 15 to slip around the pump shaft circumference during the operation, since the pump shaft is under increased thrust load exerted on its periphery by the mechanical seal 30 in a way to counteract the pump shaft rotation. In some instances where pumps employ a driven gear 15 made of synthetic resin material, in order to insure proper transmission of the torque from the driven gear 15 to the pump shaft 11, a bushing 13 made of metal material is formed in the central bore of the driven gear 15 into which the pump shaft 11 is pressure inserted, as may best depicted, .in FIG. 5. As shown, the bushing 13 may be made to contact the front face **8*b* of the boss 8*a* so as to prevent the pump shaft 11 from coming off from its bore in the pump body 8**.

However, these conventional coolant pumps have been known to pose various problems owing to their designs. First, the use of two ball bearings 40 in the boss **8*a* add extra parts and assembling costs and weight. Furthermore, this arrangement require a rather great length of shaft on the impeller side. Another problem is that the use of a metal bushing 13 made integrated with the driven gear 15** complicates the construction, with a resultant increase in production costs.

The present invention has been proposed to eliminate the above-mentioned disadvantages with the prior art coolant pumps.

SUMMARY OF THE INVENTION

It is therefore a primary object of the present invention to provide an improved drive device for coolant pumps which is simple in construction and can be produced at a low cost.

It is an additional object of the present invention to provide such a drive device in which the pump shaft is secured in such a manner that prevents it from coming off from its bore in the pump body.

It is another object of the present invention to provide such a drive device in which the pump shaft is secured in the central bore of the driven gear without the use of metal bushing.

It is still another object of the present invention to provide such a drive device in which the driven gear is fixedly fitted about the circumference of the pump shaft in such a manner that prevent the gear from coming off from the shaft, without the use of cir-clip grooves formed in the shaft periphery.

The above and other objects, features and advantages of the present invention will be appreciated from the following specification when read in conjunction with the accompanying drawings.

BRIEF EXPLANATION OF THE DRAWING

In the drawings, like parts are referred to by like reference numbers.

DETAILED DESCRIPTION OF PREFERRED EMBODIMENTS

The preferred embodiments according to the present invention will be described in great detail in conjunction with the accompanying drawings.

Figure 1:
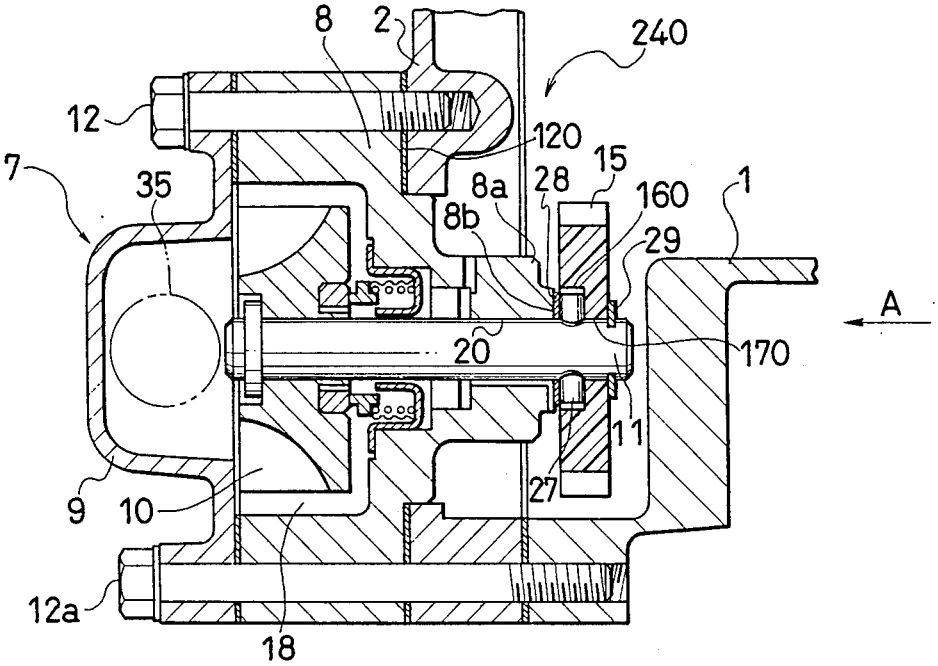
FIG. 1 is a longitudinal cross-sectional view of a first preferred embodiment of the gear drive according to the present invention.
Figure 4:
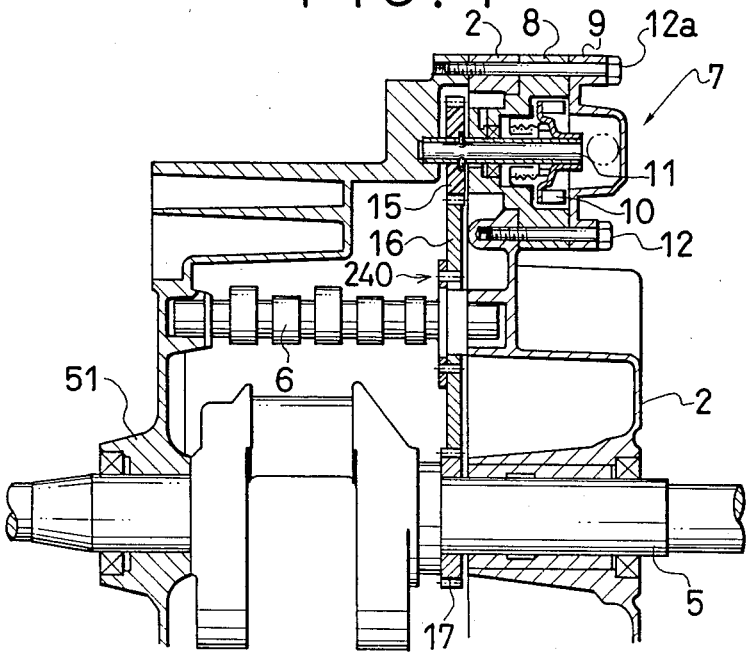
FIG. 4 is a longitudinal cross-sectional view of a crankcase in which the pump according to the present invention is installed.
Figure 5:
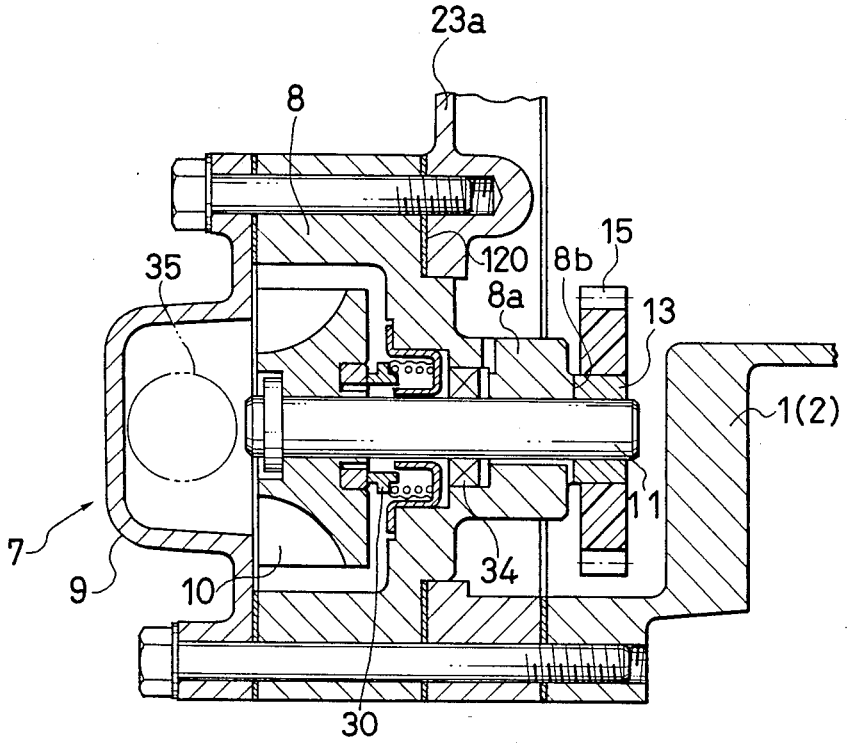
FIG. 5 PRIOR ART
FIGS. 5 and 6 are respectively longitudinal cross-sectional views of the typical conventional drive devices.
Figure 6:
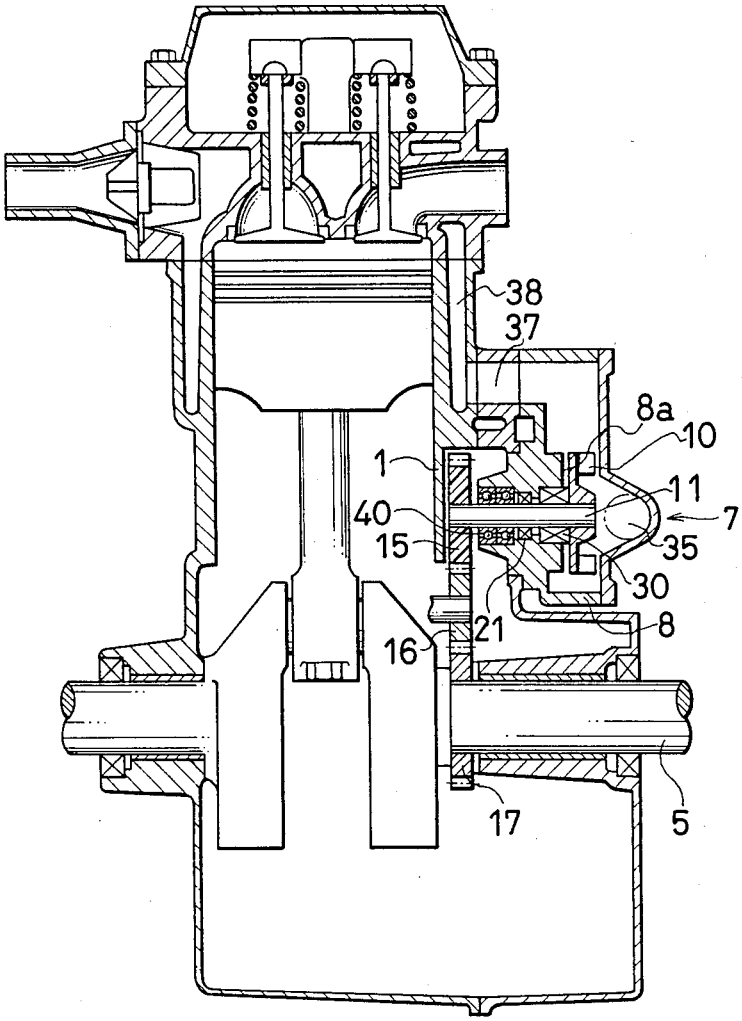
FIG. 6 PRIOR ART

Referring first FIG. 1, the numeral 7 largely designates a pump for supplying coolant, constructed in accordance with a first preferred embodiment of this invention, to the coolant jacket of an internal combustion engine. The pump 7 is secured to a crankcase cover 2 with bolts 12 that support the pump in fixed position, together with bolts **12*a* attaching it on the opposite side to the crankcase 2 of the engine 1. The pump 7 is a conventional type, except for the improvements to which this invention relates, comprising a pump body 8, a pump shaft 11 carrying, at one end portion thereof, an impeller 10 encased in a pump body 8 and, at the other end, a driven gear 15, and an inlet port 35 which admits coolant from a radiator, not shown, into the pump casing 9 through a piping. The driven gear 15, as may best be shown in FIG. 4, is connected in mesh engagement through an intermediate gear such as a camshaft gear 16** with a drive gear 17 mounted on a crankshaft 5 which transmits the torque from the engine to the driven gear 15 which in turn rotates the pump shaft 11 and hence the impeller 10 to move the coolant in the pump chamber 18, causing it to circulate through the coolant jacket for engine cooling via an outlet, not shown, arranged radially, outwardly of the axis of the pump shaft 11.

The pump body 8 includes a boss 8*a* having a bore 20 in which the pump shaft 11 is rotatably disposed. The driven gear 15 has a collar 29 fixed to a front end portion of the pump shaft 11 to prevent the driven gear 15 from coming off from the pump shaft 11. Also, the driven gear 15 has a couple of inner grooves 160 radially extending to opposite side of a bore 170 in which the pump shaft 11 is set. The inner grooves 160 may be equal in length to one another. They are provided to fittingly receive a pin 27 fixedly implanted in the circumference of the pump shaft 11. The inner grooves 160 are opened on that side of the driven gear 15 facing the impeller 10 and the pin 27 are held against the front end wall of the boss 8*a*. through a washer 28 fitted about the pump shaft 11. The location of the collar 29, which may be detachably mounted in order to ease disassembly for maintenance, on the shaft is determined so as to hold the pin 27 within the inner grooves 160, so that, when the driven gear 15 is driven by the crankshaft 5, the pin 27 fitted in the inner grooves 160 is rotated by the gear to turn the pump shaft 11 in unison.

With this arrangement, the driven gear 15 is physically integrated with the pump shaft 11 for unitary rotation without slip between them in operation. Also, this construction eliminates the conventional metal bushing generally integrated in a synthetic resin driven gear 15 to secure tightness between the gear and the shaft pressure inserted into the bore of the bushing, without losing the required force of the shaft to transmit the torque of the pump gear 15 in high-speed rotation, enough to withstand high stresses developed in the power transmission. Furthermore, this structure can reduce construction costs, owing to the reduced number of expensive parts and operations of pressure fitting the shaft into the metal bushing, and improve maintenability.

Figure 2:
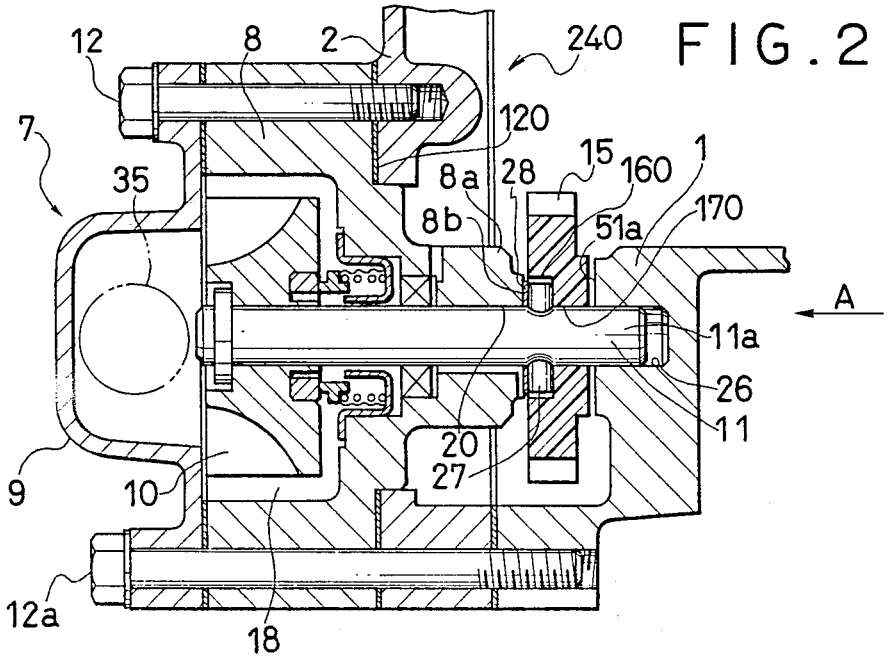
FIG. 2 is a longitudinal cross-sectional view of a second preferred embodiment.

Referring to FIG. 2, which illustrates a modification of the above-mentioned embodiment, the pump shaft 11 is supported at a front end portion 11*a* thereof in a bore 26 formed in the wall of the crankcase of the engine 1. The spacing between the face of the driven gear 15 and the opposing crankcase wall is determined such that the pump shaft 11 is prevented from falling off from its bore 20. Also, this construction eliminates the collar 29, thereby contributing to reducing the space for accommodating a coolant pump body in the crankcase.

Figure 3:
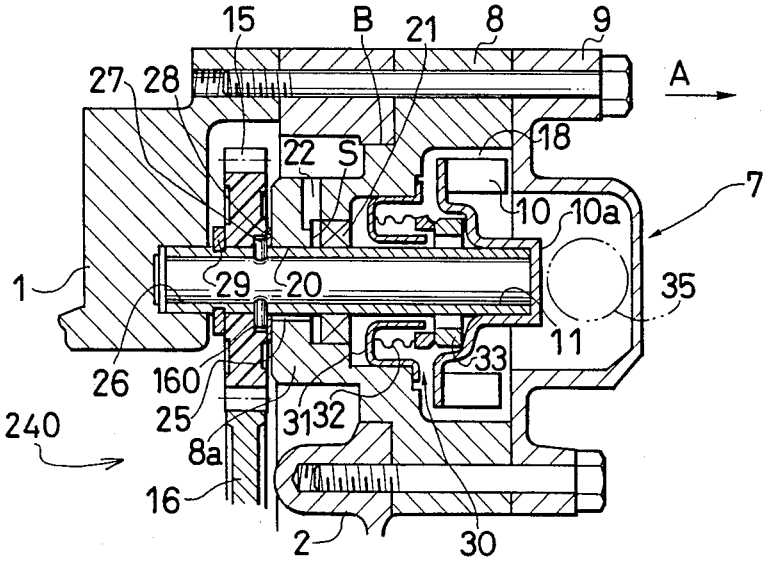
FIG. 3 is a longitudinal cross-sectional view of a third preferred embodiment.

Referring to FIG. 3, which illustrates another embodiment of the present invention, a coolant pump 7 has also a couple of radially extending inner grooves 160 formed in a driven gear 15 to insert therein the fixed pin 27 implanted in radial pattern in the circumference of the pump shaft 11 in substantially the same manner as in the first preferred embodiment described earlier. An impeller 10 comprises a hub portion 10*a* which may be made integral with the impeller 10 by sheeting. The pump shaft 11 is pressure fitted at a rear end portion thereof into the hub 10*a* for rotation therewith.

The pump shaft 11 is rotatably supported at a front end portion thereof in a bore 20 formed in a boss 8*a* in the pump body 8. Also, an oil supply passage 22 is defined in the pump body 8 to supply lubricating oil to reduce the friction of the pump shaft rotation in the bore 20. An annular space S is formed about the pump shaft 11 to communicate the oil supply passage 22 with the gap between the contacted surfaces of the pump shaft 11 and bore 20 in oil-flow relationship.

Adjacent to the space S is provided an annular oil seal 21, mounted between the impeller 10 and bore 20 to prevent leakage of lubricating oil in the spaces.

A mechanical seal 30 is provided mounted adjacent to the oil seal 21 to prevent leakage of the coolant in the pump chamber 18 on the opposite side of the impeller 10, and comprises a seat ring 33, a support ring 31, and a spring 32. The support ring 31 is fitted inside the seat ring 33 disposed in fixed position. The mechanical seal 30 has its spring 32 held against the bottom of the hub 10*a* urging the impeller 10 in the direction of the arrow A.

The pump shaft 11 is supported at a front end portion thereof in a bore 26 formed in the wall of the crankcase of the engine 1. The space 240 between the crankcase wall and the driven gear 15 is opened into the inside of the crankcase so that the bore 26 is lubricated with oil mist present in the crankcase.

With the above arrangement, the pump shaft 11 is supported in the bores 20 and 26 in proper lubrication enough to reduce the friction of the pump shaft rotation, without the use of bearings 40 in the boss 8*a*, with a resultant reduction in the parts used, assembling cost and labor and noise during the rotation.

This construction can also reduce the overall weight of a coolant pump from the elimination of the bearings and, by decreasing the axial length of the pump bore to support the shaft, the pump axial length as well, since the shaft is supported at two opposite ends.

In one representative method of constructing the pump according to this invention, the pump shaft 11 with the impeller 10 pressure fitted thereabout is inserted through the bore 20 into the pump body 8 in which the oil seal 21 and mechanical seal 30 is preinstalled. Then, the washer 28 and a pin 27 are mounted and the driven gear 15 are fitted on the pump shaft 11 in such a way that the pin 27 are properly housed in the inner grooves 160 in the driven gear 15. Then, an end collar 29 is fitted. The pump 7 thus assembled is then secured to the crankcase of the engine 1 with bolts 12 and 12*a*.

The pump 7 may be mounted in the crankcase cover 2 in a socket and spigot joint, as shown in B, with knock pins, not shown, to locate the pump body 8 in an precise position to insure alignment between the pump shaft 11 and bore 20.

The above description refers to application of the present invention in crankcases. However, the pump 7 may also be mounted on transmission cases for two-wheeled vehicles.

In addition, this invention can be applied to coolant pumps whose impeller shafts are driven by a gear that is driven from the crankshaft by means of a power transmission chain.

It is to be understood that changes and modifications are possible without departing from the spirit of the present invention and the scope of this invention should be protected, not by the above description and accompanying drawing given by way of illustration, but by the appended claims.

What is claimed is:

1. In a liquid-cooled internal combustion engine having a crankcase with a wall, an opening in said wall, and a crankshaft: a coolant pump having a pump body mounted in said opening and having a front end wall, a boss formed in said front end wall, a bore in said boss, a pump shaft rotatably journaled in said bore, said pump shaft having a forward end portion with a through hole extending diametrically through said pump shaft, a driven gear on said pump shaft and being drivingly connected to said crankshaft, a pin fixedly mounted in said through hole such that opposite ends of said pin project from said through hole, a pair of grooves formed in said drive gear and facing a front end wall of said boss and fittingly receiving therein said projecting ends of said pin to thereby fixedly mount said drive gear to said pump shaft, and a washer mounted around said pump shaft between said front end wall of said boss and said projecting ends of said pin.

2. The coolant pump according to claim 4, wherein said crankcase has a further opening in a wall opposite said boss, and wherein said pump shaft has a portion rotatably supported in said further opening.

* * * * *